US008500241B2

(12) United States Patent
Yazawa

(10) Patent No.: US 8,500,241 B2
(45) Date of Patent: Aug. 6, 2013

(54) IMAGE RECORDING APPARATUS

(75) Inventor: Hiroaki Yazawa, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 222 days.

(21) Appl. No.: 13/036,144

(22) Filed: Feb. 28, 2011

(65) Prior Publication Data

US 2011/0242209 A1 Oct. 6, 2011

(30) Foreign Application Priority Data

Mar. 31, 2010 (JP) ..... 2010-083486

(51) Int. Cl.
*B41J 23/00* (2006.01)

(52) U.S. Cl.
USPC ..... 347/37; 347/86

(58) Field of Classification Search
USPC ..... 347/22, 29, 32, 33, 37, 40, 43, 85, 347/86
See application file for complete search history.

(56) References Cited

U.S. PATENT DOCUMENTS 5,631,681 A * 5/1997 Klaus et al. ..... 347/85
6,179,401 B1 * 1/2001 Stephens et al. ..... 347/19

FOREIGN PATENT DOCUMENTS

JP 2002-036597 2/2002
JP 2004-114363 4/2004
JP 2009-248361 10/2009

* cited by examiner

*Primary Examiner* — Thinh Nguyen
(74) *Attorney, Agent, or Firm* — Frommer Lawrence & Haug LLP

(57) ABSTRACT

There is provided an image recording apparatus including: a casing; a carriage unit which is movable in the casing in a scanning direction intersecting with a transporting direction of a medium; a liquid jetting head mounted on the carriage unit; and a controller which controls the carriage unit and the liquid jetting head so that the carriage unit reciprocates within a predetermined range in the scanning direction under a condition that the liquid jetting head jets the liquid to the medium, and that the carriage unit moves to a cartridge exchange position under a condition that the mounted liquid cartridge is to be changed, the cartridge exchange position being adjacent to the exchange port and being located outside the predetermined range in the scanning direction.

9 Claims, 10 Drawing Sheets

IMAGE RECORDING APPARATUS

CROSS REFERENCE TO RELATED APPLICATION

The present application claims priority from Japanese Patent Application No. 2010-083486, filed on Mar. 31, 2010, the disclosure of which is incorporated herein by reference in its entirety.

BACKGROUND OF THE INVENTION

1. Field of the Invention

The present invention relates to an image recording apparatus such as, for example, an ink jet printer, in which a liquid jetting head jetting liquid is mounted on a carriage unit, and particularly to an image recording apparatus of what is called an on-carriage type in which liquid cartridges are mounted on a carriage unit.

2. Description of the Related Art

There is known an ink-jet printer of what is called an on-carriage type in which an ink-jet head and ink-cartridges are mounted on a carriage configured to be reciprocatable in a casing. In an ordinary printer of the on-carriage type, an upper cover is provided on top of the casing. In order to change the ink cartridge, a user needs to open the casing by swinging the upper cover upward. Upon the operation of the upper cover, the carriage moves to a exchange position in the casing, and when the carriage stops at the exchange position, the user can access the ink cartridge mounted on the carriage from an upper side of a front surface of the casing (refer to, for example, Japanese Patent Application Laid-open No. 2009-248361). Further, in an ordinary printer of an on-carriage type, a plurality of nozzle arrays provided on a lower surface of the ink-jet head are disposed so as to line up in a scanning direction of the carriage. Further, right above the nozzle arrays, the plural ink cartridges disposed so as to line up in the scanning direction similarly to the nozzle arrays are mounted on the carriage.

For example, in a printer including a scanner of a flat bed type, an upper cover tends to become large. When the method for changing the ink cartridge described in Japanese Patent Application Laid-open No. 2009-248361 is applied to this printer, the operation of the upper cover at the time of the change becomes complicated. Therefore, there has been proposed a printer of an on-carriage type whose ink cartridge is changeable at a side of a casing (refer to, for example, Japanese Patent Application Laid-open No. 2002-036597).

According to Japanese Patent Application Laid-open No. 2002-036597, a carriage is reciprocatable in a scanning direction perpendicular to a transporting direction of a medium by being guided by a scanning shaft and one end side of the scanning shaft is extensible/contractible in the scanning direction. In a sidewall of the casing, a hole allowing the carriage to pass therethrough is formed at a position to which the scanning shaft is extended toward this one end side. At the time of the change of the ink cartridge, the carriage is moved toward the one end side. Then, the carriage passes through the hole while the scanning shaft is extending, and protrudes to the outside of the casing together with the scanning shaft. Thus, in the printer described in Japanese Patent Application Laid-open No. 2002-036597, since the exchange position can be located outside the casing, the operation of the upper cover is not required at the time of the change of the ink cartridge.

However, in the printer described in Japanese Patent Application Laid-open No. 2002-036597, the ink cartridges are mounted on the carriage so as to line up in the scanning direction, and at the time of the change of the ink cartridges, the ink cartridges are removed from/inserted to the carriage in the transporting direction. Because of this, the exchange position has to be located outside the casing as described above.

Specifically, in the printer described in Japanese Patent Application Laid-open No. 2002-036597, if the exchange position is located inside the casing, the ink cartridge closest to the hole hides the ink cartridges on a deeper side in spite of a user's attempt to access the carriages in the casing via the hole from the outside of the casing. The user is not capable of reaching the ink cartridges located on the deeper side, nor is he/she capable of even seeing them well. On the other hand, the user is capable of reaching the ink cartridge closest to the hole but has a great trouble in pulling/inserting the ink cartridge in the transporting direction while putting his/her hand in the casing via the hole.

Therefore, in order to enable the easy change of all the ink cartridges, the carriages have to be moved so that all the ink cartridges including the ink cartridge which is farthest from the hole in a state where the carriage is located inside the casing are exposed outside the casing. That is, the ink cartridge closest to the hole and thus has good accessibility greatly protrudes outside the casing. Setting the exchange position of the ink cartridges outside the casing results in poor space efficiency because of the need for reserving a space to allow the carriage located at the exchange position to escape thereto. Thus, in the conventional art, it is difficult to realize both the easy change of the ink cartridge and high space efficiency.

SUMMARY OF THE INVENTION

Therefore, it is an object of the present invention to provide an image recording apparatus of an on-carriage type realizing the easy change of liquid cartridges and high space efficiency.

According to an aspect of the present invention, there is provided an image recording apparatus which jets a liquid stored in cartridges onto a medium to records an image, the apparatus including:

a casing in which a cartridge exchange port, via which the cartridges are exchanged, is formed;

a carriage unit which is movable in the casing in a scanning direction intersecting with a transporting direction of the medium and in which the liquid cartridges are removably installed and are aligned in the transporting direction;

a liquid jetting head mounted on the carriage unit, on which a plurality of nozzle arrays through which the liquid supplied from the liquid cartridges is jetted is formed to be aligned in the scanning direction; and a controller which controls the carriage unit and the liquid jetting head so that the carriage unit reciprocates within a predetermined range in the scanning direction under a condition that the liquid jetting head jets the liquid to the medium, and that the carriage unit moves to a cartridge exchange position under a condition that the mounted liquid cartridge is to be changed, the cartridge exchange position being adjacent to the exchange port and being located outside the predetermined range in the scanning direction.

According to the above-described structure, in the image recording apparatus in which the plural nozzle arrays of the liquid jetting head are disposed so as to line up in the scanning direction, the cartridge exchange port is provided in the apparatus casing so as to be adjacent to the cartridge exchange position in the scanning direction, and the plural liquid cartridges are mounted on the carriage unit so as to line up in the transporting direction. Therefore, when the carriage unit is located at the cartridge exchange position, a user can access the liquid cartridges mounted on the carriage unit via the cartridge exchange port from the outside of the apparatus casing with equal accessibility. Therefore, it is possible to easily change all the liquid cartridges by pulling/inserting the liquid cartridges in the scanning direction, and a large space to allow the carriage unit to escape thereto need not be reserved outside the apparatus casing.

According to the present invention, it is possible to provide an image recording apparatus of an on-carriage type realizing the easy change of liquid cartridges and high space efficiency.

DETAILED DESCRIPTION OF THE PREFERRED EMBODIMENTS

Hereinafter, embodiments of the present invention will be explained with reference to the drawings. Here, as the embodiments of an image recording apparatus according to the present teaching, a multifunction printer of what is called an on-carriage type is described as an example, and a direction in which the multifunction printer jets ink will be defined as a lower side.

First Embodiment

Figure 1:
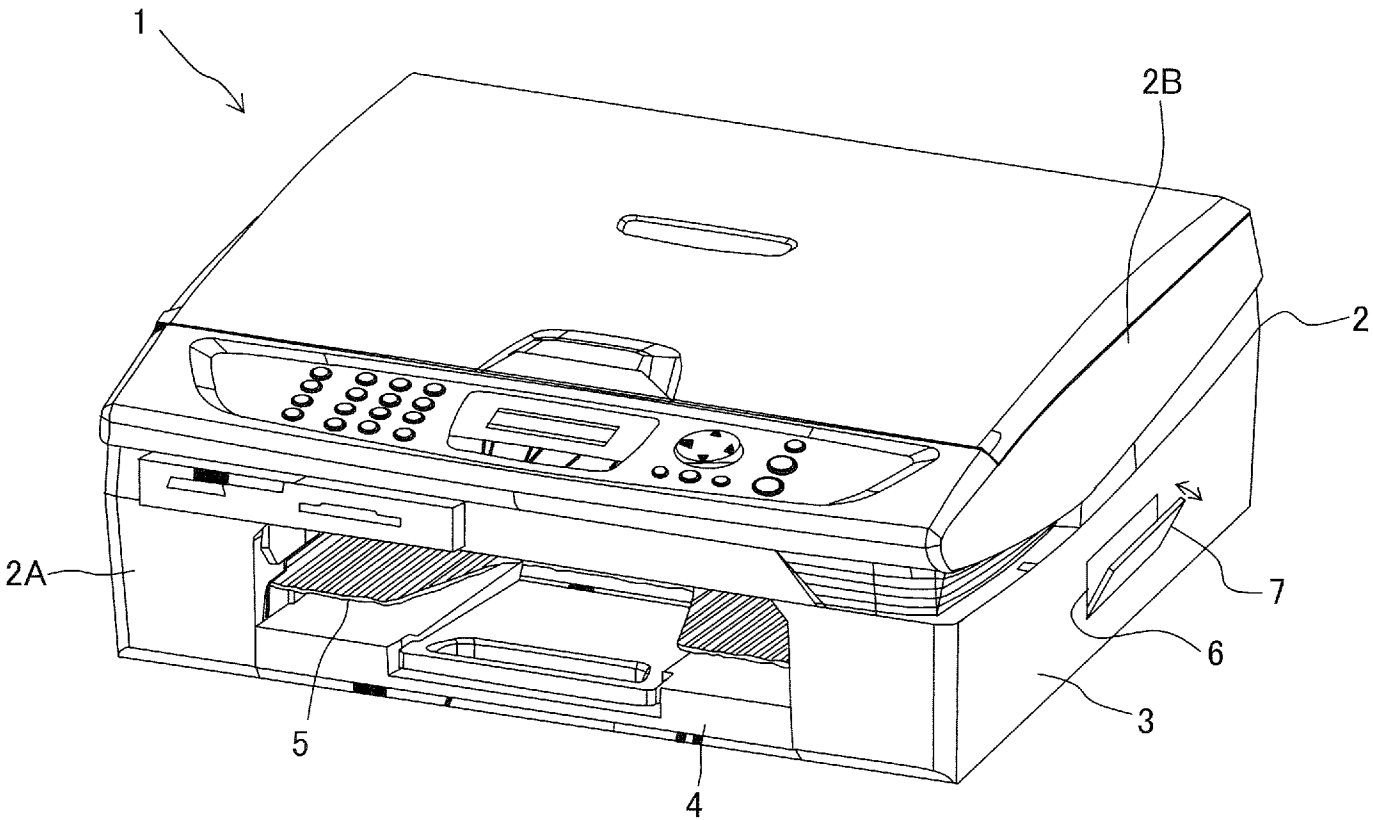
FIG. 1 is a perspective view showing an exterior of a multifunction printer according to a first embodiment of the present invention.

As shown in FIG. 1, the multifunction printer 1 includes a casing 2 in a rectangular parallelepiped shape. The casing 2 has a casing body 2A and an upper cover 2B swingably attached to an upper side of the casing body 2A. In an upper surface of the casing body 2A, an opening (not shown) is formed. A printer unit jetting the ink to record an image onto a paper M (refer to FIG. 2) is housed in the casing body 2A, and a scanner unit of a flat bed type is provided on the upper cover 2B. When the upper cover 2B is swung, the casing body 2A is opened. Consequently, a user can access the inside of the casing 2.

In a frontal lower portion of the casing body 2A, a paper feeding tray 4 and a paper discharge tray 5 are provided, being stacked up and down, and the papers M (refer to FIG. 2) are housed in the paper feeding tray 4 and the paper discharge tray 5. In one side surface 3 of the casing body 2A, a cartridge exchange port 6 is formed so as to penetrate through the side surface 3, and an access cover 7 with which the cartridge exchange port 6 is opened/closed is provided. As will be described later, a user can change an ink cartridge 17 (refer to FIG. 2) by using the cartridge exchange port 6 without operating the upper cover 2B. FIG. 1 shows an example where the cartridge exchange port 6 is in a rectangular shape and the access cover 7 is of an out-swing type, with its support shaft extending in a front and back direction along a lower edge portion of the cartridge exchange port 6, but these structures are only examples and appropriately changeable.

Figure 2:
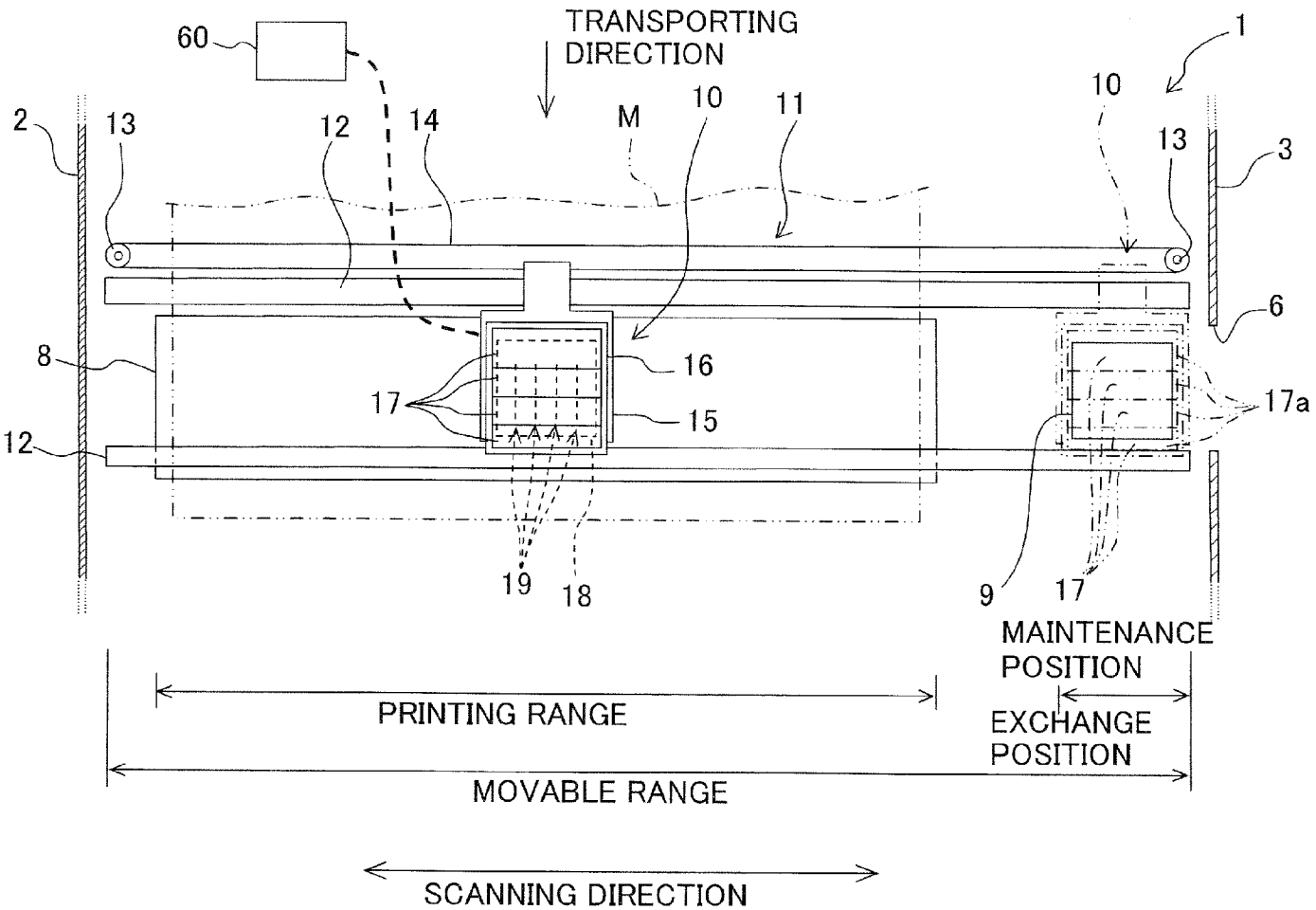
FIG. 2 is a schematic plane view of the multifunction printer shown in FIG. 1.

As shown in FIG. 2, in the casing 2, a platen 8 having a horizontal upper surface is disposed. The paper M in the paper feeding tray 4 (refer to FIG. 1) is transported on an upper surface of the platen 8 along a horizontal transporting direction to be sent to the paper discharge tray 6 (refer to FIG. 1) on the frontal side.

Above the platen 8, there are provided a carriage unit 10 movable in a horizontal scanning direction perpendicular to the transporting direction and a scanning mechanism 11 moving the carriage unit 10 in the scanning direction. The scanning mechanism 11 has guide members 12 extending in the scanning direction in the casing 2, a pair of pulleys 13 disposed close to end portions of the guide member 12, and a belt 14 wrapped around the pair of pulleys 13. A scanning motor (not shown) is connected to one of the pair of pulleys 13, and the scanning motor is controlled by a control section 60. The carriage unit 10 includes a carriage body 15 supported by the guide members 12 and fixed to the belt 14. When the pulleys 13 are driven to rotate by the control section 60 controlling the scanning motor, the belt 14 moves around, so that the carriage body 15 moves in the scanning direction by being guided by the guide members 12. The scanning mechanism 11 is disposed inside the casing 2, and therefore a movable range of the carriage unit 10 is also within the casing 2.

A cartridge holder 16 is attached to the carriage body 15, and a plurality of ink cartridges 17 are removably installed in the cartridge holder 16. The ink cartridges 17 are mounted on the carriage unit 10 so as to line up in the transporting direction. Further, on an underside of the carriage body 15, an ink-jet head 18 is mounted, and a lower surface of the ink-jet head 18 is horizontally disposed so as to face the upper surface of the platen 8. On the lower surface of the ink-jet head 18, a plurality of nozzle arrays 19 for jetting the ink supplied from the ink cartridges 17 are provided. In each of the nozzle arrays 19, a plurality of nozzles jetting ink droplets are aligned along the transporting direction. The nozzle arrays 19 are disposed so as to line up in the scanning direction.

In this embodiment, the four ink cartridges 17 are mounted on the carriage unit 10, and the four nozzle arrays 19 are provided on the ink-jet head 18. The ink cartridges 17 store inks in different colors (for example, black, cyan, magenta, and yellow) respectively, and the nozzle arrays 19 jet the inks supplied from the corresponding ink cartridges 17, that is, the inks in different colors respectively.

In the movable range of the carriage unit 10, a predetermined range overlapping with the platen 8 in a plane view will be defined as "a printing range". During image recording to the paper M by the ink-jet head 18 jetting the ink toward the paper M, the carriage unit 10 is reciprocated in the printing range and the paper M is transported. At this time, the lower surface of the ink-jet head 18 is close to and faces a recording surface of the paper M which passes on the platen 8 in the transporting direction. When the ink is jetted from the nozzle array 19 in this state, the ink jetted to the recording surface of the paper M lands on the recording surface. Since the plural nozzle arrays 19 extending in the transporting direction line up in the scanning direction which is a movement direction of the carriage unit 10, it is possible to record an image of desired colors at high speed.

When the carriage unit 10 is located at a maintenance position adjacent to the printing range, the ink-jet head 18 is disposed above a maintenance station 9 adjacent to the platen 8 in the scanning direction. The maintenance station 9 performs the maintenance of the ink-jet head 18 such as the wiping of the lower surface of the ink-jet head 18, the sealing of the nozzle arrays 19, and the deaeration of the inside of the ink-jet head 18. When determining that the maintenance is necessary, for example, immediately after the change of the ink cartridge 17, the control section 60 moves the carriage unit 10 to the maintenance position and stops it there.

In the movable range of the carriage unit 10, "a exchange position" is provided at a position apart from the printing range. When determining that the exchange of the ink cartridge 17 is necessary, such as when detecting that the remaining ink in the ink cartridge 17 is almost zero and when detecting a change request by a user, the control section 60 moves the carriage unit 10 to the exchange position to stop it there. Note that it is possible to determine the presence/absence of the change request by using, for example, a switch (not shown) for detecting whether or not the access cover 7 is closed. In this embodiment, the exchange position is located at the same position as the maintenance position. This eliminates a need for moving the carriage unit 10 when the maintenance is performed immediately after the ink cartridge 17 is changed, and makes it possible to downsize the casing 2 in the scanning direction. It should be noted that the maintenance position may be located at a position different from the exchange position.

The exchange position is located in one end portion of the movable range of the carriage unit 10. The movable range covers substantially the whole scanning direction inside the casing 2. The exchange position is close to an inner surface of the casing 2. The cartridge exchange port 6 is provided so as to be adjacent to such a exchange position in the scanning direction.

In a view seen from the outside of the casing 2 in the scanning direction, all the ink cartridges 17 on the carriage unit 10 are located inside the cartridge exchange port 6. Therefore, when the carriage unit 10 is at the exchange position, all the ink cartridges 17 mounted on the carriage unit 10 can be visually recognized via the cartridge exchange port 6 from the outside of the casing 2.

The ink cartridges 17 are removably installed on the carriage unit 10 so as to align in the transporting direction. Therefore end surfaces 17*a* of the ink cartridges 17, facing the cartridge exchange port 6 line up in the transporting direction, and distances from the end surfaces 17*a* of the respective ink cartridges 17 to the cartridge exchange port 6 are substantially equal to one another. Therefore, accessibility to the ink cartridges 17 via the cartridge exchange port 6 becomes equal. This can avoid a conventional situation that an ink cartridge with good accessibility has to greatly protrude to the outside of the casing in order to enable the easy change of an ink cartridge with poor accessibility. Thus, according to this embodiment, it is also possible to reduce a space that is to be reserved outside the casing 2 for changing the ink cartridge 17, and realize both the easy change of the ink cartridge 17 and high space efficiency.

It is also possible to dispose, inside the casing 2, the ink cartridges 17 mounted on the carriage unit 10, in a state where the carriage unit 10 is located at the exchange position. Even in this structure, a user can access all the ink cartridges 17 from the outside of the casing 2 via the cartridge exchange port 6, which can ensure the easy change. Setting the exchange position inside the casing 2 enables higher space efficiency. Of course, at least a part of the carriage unit 10 located at the exchange position may protrude to the outside from the cartridge exchange port 6 to such a degree that space efficiency is not worsened.

Figure 3:
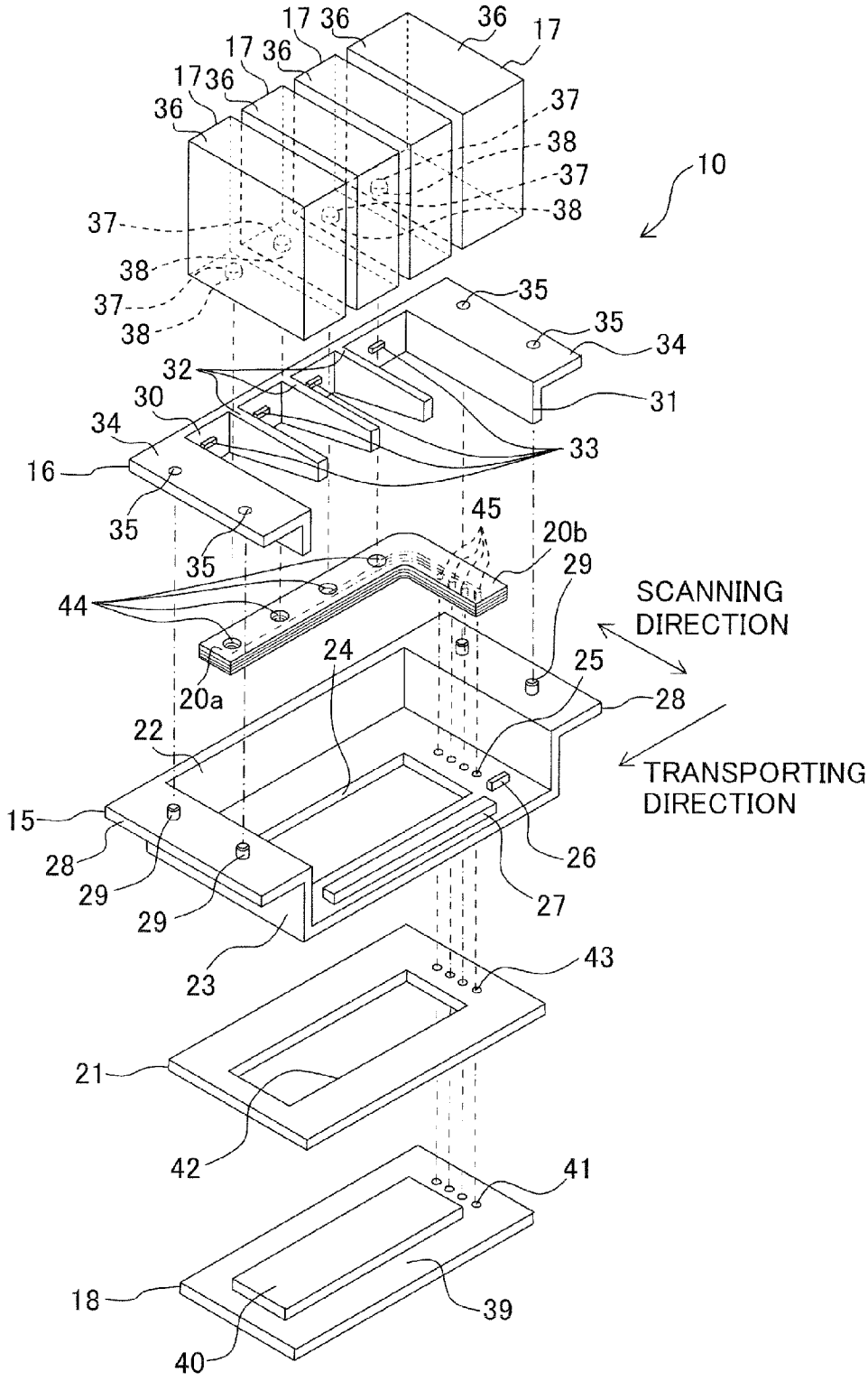
FIG. 3 is an exploded perspective view of a carriage unit shown in FIG. 2.
Figure 4:
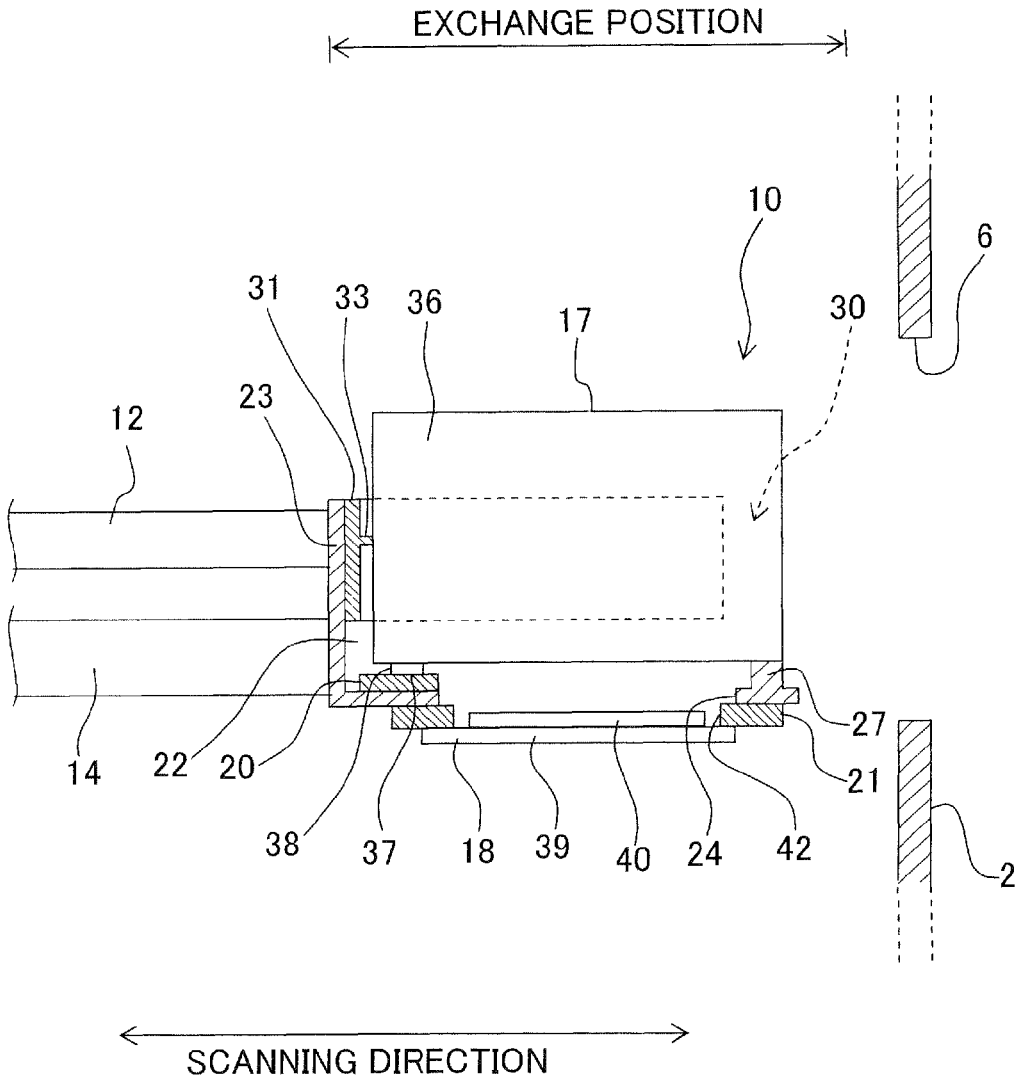
FIG. 4 is a front sectional view of the carriage unit shown in FIG. 3 in an assembled state.

Next, a concrete structure of the carriage unit 10 will be explained. As shown in FIGS. 3 and 4, the carriage unit 10 has a channel forming member 20 and a reinforcing plate 21 in addition to the aforesaid carriage body 15, cartridge holder 16, ink cartridges 17, and ink-jet head 18.

The carriage body 15 has a box portion 23 forming an indented portion 22. The box portion 23 is formed in a U-shape when seen from one side in the scanning direction, and an upper side of the indented portion 22 and the one side in the scanning direction of the indented portion 22 facing the cartridge exchange port 6 are opened. In a center portion of a bottom wall of the box portion 23, an opening 24 in a rectangular shape is formed so as to penetrate through the bottom wall. Further, in the bottom wall of the box portion 23, four openings 25 arranged in a line in the scanning direction are formed at positions adjacent to the opening 24 in the transporting direction so as to penetrate through the bottom wall. Further, a rib 26 for positioning the channel forming member 20 and a stay 27 for horizontally supporting the ink cartridges 17 are provided integrally on an inner bottom surface of the box portion 23. The stay 27 is adjacent to the opening 24 in the scanning direction and extends in the transporting direction. A pair of flange portions 28 extend from upper ends of the box portion 23 so as to be apart from each other in the transporting direction, and pins 29 protrude upward from an upper surface of each of the flange portions 28. Incidentally, a supported portion (not shown) supported by the guide member 12 (refer to FIG. 2) is provided on a lower surface of the flange portion 28 on one side in the transporting direction.

The cartridge holder 16 has a hold portion 31 forming a cartridge housing space 30. The hold portion 31 is formed in a U-shape in a plane view, and three sides of the cartridge housing space 31, that is, its upper and lower sides and side facing the cartridge exchange port 6 (that is, one side in the scanning direction) are opened.

Three ribs 32 project from an inner surface, of the hold portion 31, on the other side in the scanning direction. These ribs 32 partition the cartridge housing space 30 into four spaces in a rectangular shape in a plane view. The ink cartridges 17 are each housed in a predetermined space out of the four spaces thus separated. These four spaces are each demarcated by the inner surface on the other side in the scanning direction of the hold portion 31 and side surfaces of the ribs 32 or an inner surface, of the hold portion 31, on one or the other side in the transporting direction, and catch claws 33 catching the ink cartridges 17 housed in the cartridge housing space 30 are provided on the surface demarcating these spaces.

Further, a pair of flange portions 34 extending from upper ends of the hold portion 31 so as to be apart from each other in the transporting direction are provided on the hold portion 31. The through holes 35 penetrating through the flange portions 34 in the up-down direction are formed in the flange portions 34.

The ink cartridges 17 each have a case 36 in a rectangular parallelepiped shape storing the ink inside. In lower surfaces of the cases 36, ink outflow holes 37 through which the inks stored in the cases 36 flow out are provided. The ink outflow holes 37 are formed inside cylindrical portions 38 projecting from the lower surfaces of the ink cartridges 17.

The ink-jet head 18 is formed so that a piezoelectric actuator 40 is stacked from an upper side of a channel unit 39 in which the ink flows. Four ink inflow holes 41 are formed in an upper surface of the channel unit 39, and the nozzle arrays 19 (refer to FIG. 2) are formed on a lower surface of the channel unit 39. The four ink inflow holes 41 are disposed in an end portion on one side in the transporting direction of the channel unit 39 so as to line up in the scanning direction.

The upper surface of the channel unit 39 is bonded to a lower surface of the reinforcing plate 21 in a rectangular frame shape. In a center portion of the reinforcing plate 21, an opening 42 is formed so as to penetrate through the reinforcing plate 21, and four through holes 43 adjacent to the opening 42 in the transporting direction and arranged in a line in the scanning direction are formed. When the channel unit 39 is bonded to the reinforcing plate 21, the actuator 40 is housed in the opening 42 and the ink inflow holes 41 communicate with the through holes 43.

The ink-jet head 18 is provided on a bottom portion of the carriage body 15 via the reinforcing plate 21. An upper surface of the reinforcing plate 21 is bonded to the outer bottom surface of the carriage body 15, the opening 42 of the reinforcing plate 21 communicates with the opening 24 of the carriage body 15, and the through holes 43 of the reinforcing plate 21 communicate with the through holes 25 of the carriage body 15.

The channel forming member 20 is housed in the indented portion 22 of the carriage body 15 from above, and the cartridge holder 16 is thereafter housed therein from above. The inner bottom surface of the carriage body 15 is formed in a frame shape so as to surround an outer periphery of the opening 24, and the channel forming member 20 is placed on such an inner bottom surface. Four ink inflow holes 44 arranged in a line in the transporting direction are formed in an upper surface of the channel forming member 20, and four ink outflow holes 45 arranged in a line in the scanning direction are formed in a lower surface of the channel forming member 20.

The channel forming member 20 of this embodiment is in an L-shape in a plane view, and its inflow portion 20*a* in which the ink inflow holes 44 are provided and its outflow portion 20*b* in which the ink outflow holes 45 are provided are continuously formed at a right angle. The inflow portion 20*a* is supported by a portion, of the frame-shaped inner bottom surface of the carriage body 15, on the other side in the scanning direction, and the outflow portion 20*b* is supported by the frame-shaped inner bottom surface at one side in the transporting direction. At this time, it is possible to position the channel forming member 20 relative to the carriage body 15 by making a side surface of the channel forming member 20 abut on the rib 26. When the channel forming member 20 is positioned, the ink outflow holes 45 formed in the lower surface of the channel forming member 20 communicate with the through holes 25 formed in the inner bottom surface of the carriage body 15.

Further, regarding the cartridge holder 16, the hold portion 31 is housed in the indented portion 22 and the flange portions 34 are supported by the upper surfaces of the flange portions 28 of the carriage body 15. The pins 29 of the flange portions 28 are inserted into the through holes 35 of the flange portions 34, so that the cartridge holder 16 can be fixed to the carriage body 15 in the scanning direction, the transporting direction, and the up-down direction. The ink cartridges 17 are inserted horizontally from one side to the other side in the scanning direction, thereby being housed in the cartridge housing space 30 formed by the cartridge holder 16.

As shown in FIG. 4, when the ink cartridges 17 are housed in the cartridge housing space 30, the ink outflow holes 37 of the ink cartridges 17 communicate with the ink inflow holes 44 of the channel forming member 20. Further, end portions, of the lower surfaces of the cases 36 of the ink cartridges 17, opposite the ink inflow holes 37 are supported by an upper surface of the stay 27. Consequently, the ink cartridges 17 mounted on the carriage unit 10 can be horizontally supported.

The side, of the cartridge housing space 30, facing the cartridge exchange port 6 is opened, and the side, of the indented portion 22 of the carriage body 15, facing the cartridge exchange port 6 is also opened. Consequently, in a state where the carriage unit 10 is located at the exchange position, there is no blocking component between the cartridge exchange port 6 and the cartridge housing space 30. Therefore, from the outside of the casing 2, a user can make the ink cartridge 17 caught by or released from the catch claw 33 by horizontally pulling/inserting the ink cartridge 17 in the scanning direction. Consequently, the user can change the ink cartridge 17.

Figure 5:
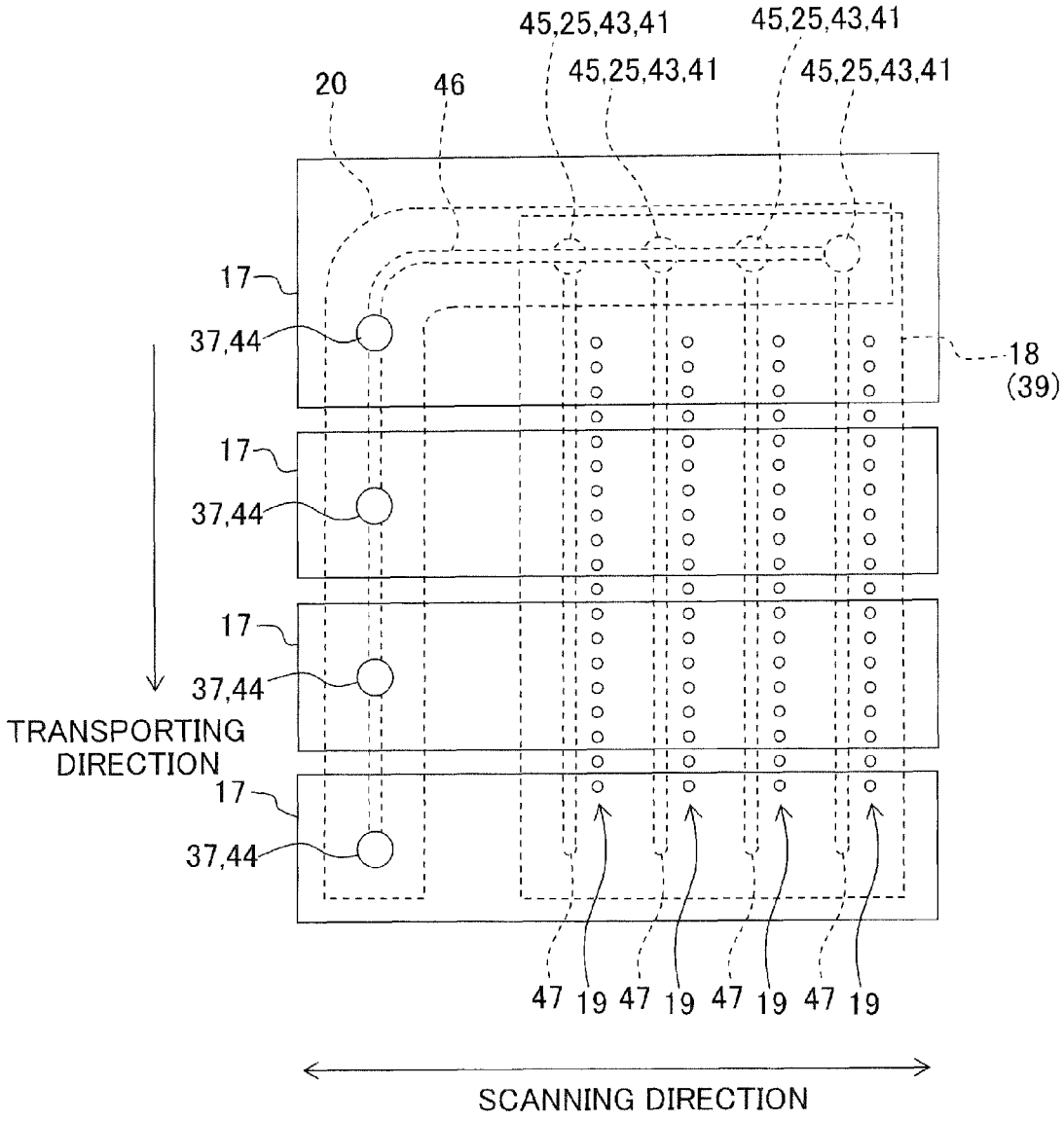
FIG. 5 is a projected plane view of ink channels in the carriage unit shown in FIG. 4.

In FIG. 5, the carriage body 15, the cartridge holder 16, the reinforcing plate 21, and the actuator 40 of the ink-jet head 18 are not shown for the explanation of the channels. As shown in FIG. 5, in the channel forming member 20, connecting channels 46 connecting the four inflow holes 44 lining up in the transporting direction to the corresponding four ink outflow holes 45 lining up in the scanning direction respectively are formed. Consequently, inner parts of the ink cartridges 17 storing the inks communicate with the ink inflow holes 41 of the channel unit 39 of the ink-jet head 18 via the ink outflow holes 37 of the ink cartridges 17, the ink inflow holes 44, connecting channels 46, and ink outflow holes 45 of the channel forming member 20, the through holes 25 of the carriage body 15, and the through holes 43 of the reinforcing plate 21. Note that the channel unit 39 has common ink chambers 47 connected to the ink inflow holes 41 to extend in the transporting direction, and the nozzles included in each of the nozzle arrays 19 communicate with the common ink chamber 47.

As described above, in the carriage unit 10 of this embodiment, the channel forming member 20 is disposed between the ink cartridges 17 and the ink-jet head 18, and the ink outflow holes 37 of the ink cartridges 17 and the ink inflow holes 41 of the ink-jet head 18 communicate with each other via the connecting channels 46 of the channel forming member 20. Since the ink cartridges 17 are mounted on the carriage unit 10 so as to line up in the transporting direction, a user can easily perform an exchange operation of the ink cartridge 17. In addition, it is also possible to realize the scanning-direction arrangement of the nozzle arrays 19.

Figure 6:
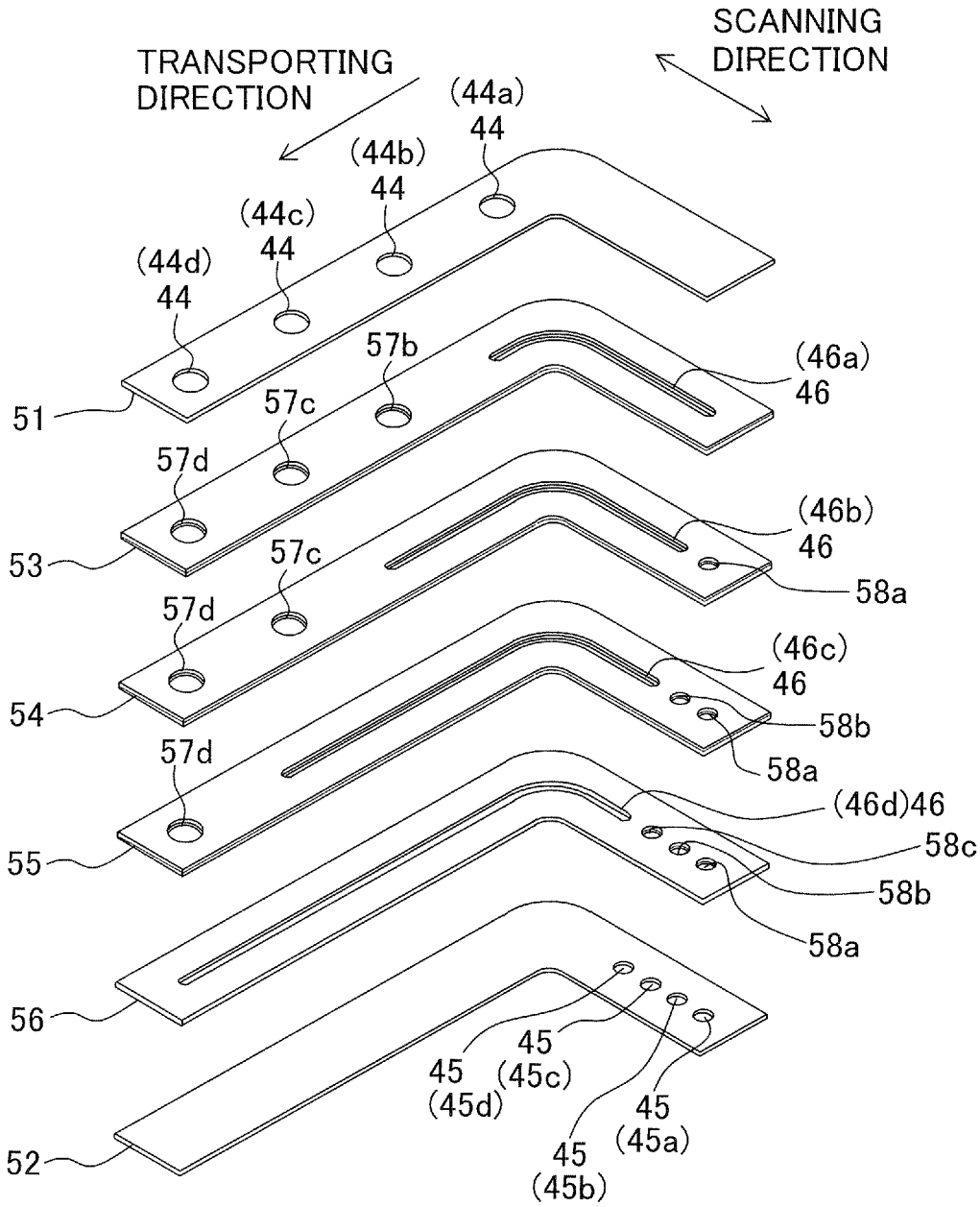
FIG. 6 is an exploded perspective view of a channel forming member shown in FIG. 3.

As shown in FIG. 6, the channel forming member 20 is formed of a stack of a plurality of plates substantially in the same shape in a plane view. These plates include an inflow plate group 51 on the top layer in which the ink inflow holes 44 are formed, an outflow plate group 52 on the bottom layer in which the ink outflow holes 45 are formed, and first to fourth channel plate groups 53 to 56 sandwiched between the inflow plate group 51 and the outflow plate group 52. The channel forming member 20 has an L-shape in a plane view, with its long portion extending in the transporting direction and with its short portion extending in the scanning direction and continuing from the long portion in a bending manner. Hereinafter, a portion where the long portion and the short portion continue will be called a continuing portion. In the long portion of the inflow plate group 51, the four ink inflow holes 44 arranged in a line are formed to pass therethrough in the up and down direction, and in the short portion of the outflow plate group 52, the four ink outflow holes 45 arranged in a line are formed.

The first to fourth channel plate groups 53 to 56 are stacked in this order from the top. In the first to fourth channel plate groups 53 to 56, connecting channels 46*a* to 46*d* in an L-shape in a plane view each extending from the long portion to the short portion via the continuing portion are formed. The first connecting channel 46*a* formed in the first channel plate group 53 is formed so as to connect a position, of the first channel group 53, located right under the ink inflow hole 44*a* that is closest to the continuing portion out of the ink inflow holes 44 and a position, of the first channel group 53, located right above the ink outflow hole 45*a* that is farthest from the continuing portion out of the ink outflow holes 45. The second connecting channel 46*b* is formed in the second channel plate group 54 and the third connecting channel 46*c* is formed in the third channel plate group 55. These second and third connecting channels 46*b*, 46*c* are formed so as to connect positions, of the second and third channel plate group 54, 55, located right under the ink inflow holes 44*b*, 44*c* that are second and third closest to the continuing portion out of the ink inflow holes 44 and positions, of the second and third channel plate group 54, 55, located right above the ink outflow holes 45*b*, 45*c* that are second and third farthest from the continuing portion out of the ink outflow holes 45. The fourth connecting channel 46*d* formed in the fourth channel plate group 56 is formed so as to connect a position, of the fourth channel plate group 56, located right under the ink inflow hole 44*d* farthest from the continuing portion out of the ink inflow holes 44 and a position, of the fourth channel plate group 56, located right above the ink inflow hole 45*d* closest to the continuing portion out of the ink outflow holes 45.

In the first to third channel plate groups 53 to 55, extension portions 57*b*, 57*c*, 57*d* extending the ink inflow holes 44 downward are formed so that the ink from the cartridge side is supplied to the connecting channel 46 formed in the plate group located on a lower layer than the relevant plate group. In each of the second to fourth channel plate groups 54 to 56, extension portions 58*a*, 58*b*, 58*c* for extending the ink outflow holes 45 upward are formed so that the ink from the connecting channel 46 formed in the plate group on an upper layer than the relevant plate group is supplied to the head side. Therefore, the first to fourth connecting channels 46*a* to 46*d* are disposed so as to be stacked in the up-down direction.

Since the first to fourth connecting channels 46*a* to 46*d* are disposed so as to be stacked in the up-down direction, it is possible to prevent the channel forming member 20 from becoming large in the horizontal direction. Since the first to fourth connecting channels 46*a* to 46*d* connect the ink inflow holes 44*a* to 44*d* and the ink outflow holes 45*a* to 45*d*, respectively, in the above-described manner, it is also possible to prevent the interference between the extension portions 57*b* to 57*d*, 58*a* to 58*c* and the connecting channels 46*a* to 46*d*.

Here, the four ink inflow holes 44 are disposed at substantially equal pitches, and the four ink outflow holes 45 are also arranged at substantially equal pitches. Based on a difference in size between the ink cartridges 17 and the ink-jet head 18, the ink inflow holes 44 and the ink outflow holes 45 are formed so that the pitch of the former becomes larger than the pitch of the latter. Therefore, the first to fourth connecting channels 46*a* to 46*d* become longer in this order. The channel sections (cross-sections) of the first to fourth connecting channels 46*a* to 46*d* of this embodiment become larger in this order. That is, one having a longer channel length has a larger channel section. Consequently, it is possible to reduce variation in channel resistance in the first to fourth connecting channels 46*a* to 46*d*, which stabilizes jetting performance of the inks from the nozzle arrays 19.

Here, the connecting channels have different channel lengths and accordingly, the connecting channels have different channel sectional areas (cross-sections), thereby eliminating variation in channel resistance in the connecting channels. However, it should be noted that the present teaching is not limited to such a structure. For example, the channel forming member may be structured so that the connecting channels have substantially the same channel length.

Figure 7:
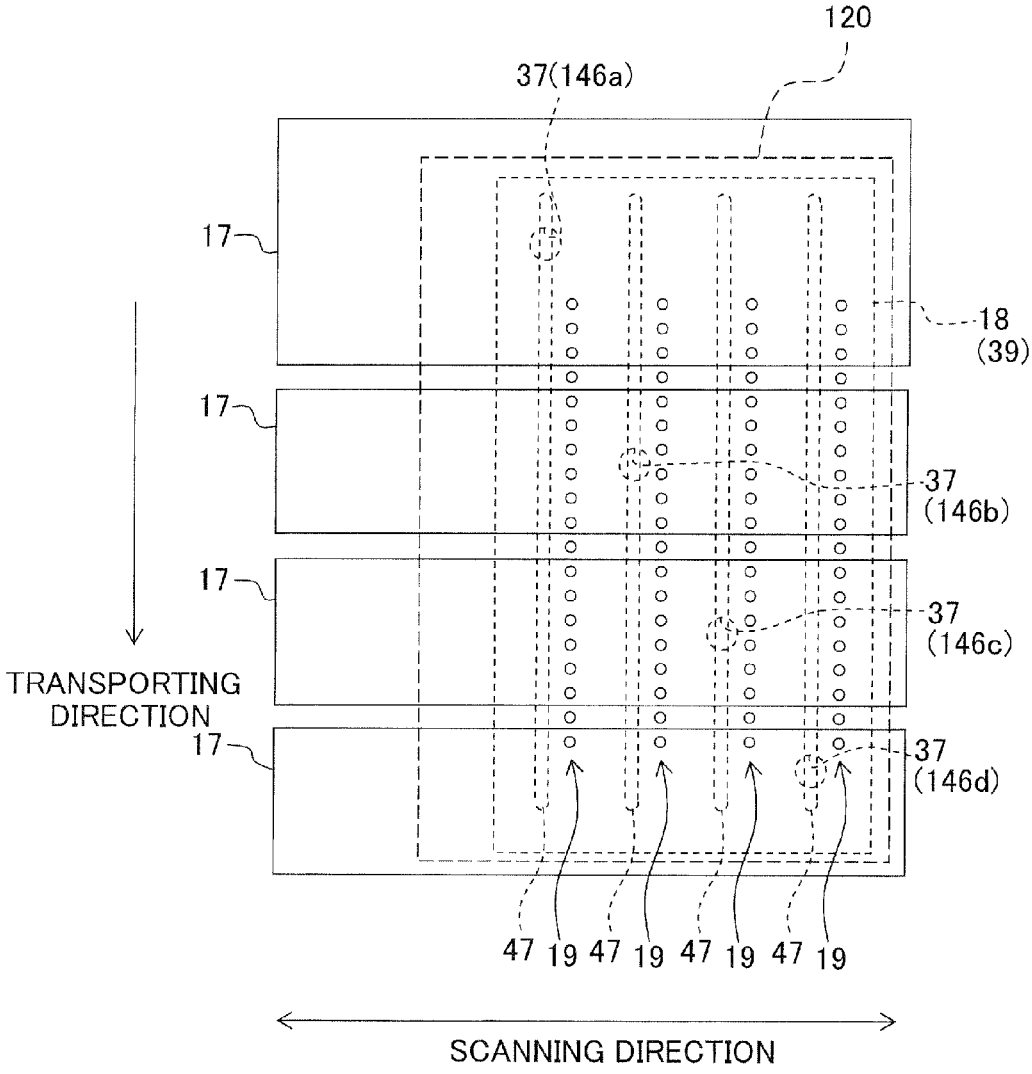
FIG. 7 is a projected plane view of another example of the channel forming member.

In this embodiment, the first to fourth connecting channels 46*a* to 46*d* have substantially an L-shape, but the present teaching is not limited to such a structure. For example, as shown in FIG. 7, in a plane view, the ink inflow holes 37 of the ink cartridges 17 may be disposed at positions overlapping with the common ink chambers 47, and first to fourth connecting channels 146*a* to 146*d* connecting the ink outflow holes 37 and the common ink chambers 47 in the up-down direction may be formed in the channel forming member 120. Since the four ink cartridges 17 are arranged in the extending direction of the common ink channel 47, the first to fourth connecting channels 146*a* to 146*d* are accordingly disposed so that their positions in terms of the extending direction of the common ink channel 47 are different from one another.

Second Embodiment

The same structures as those of the above embodiment will be denoted by the same reference numerals and symbols, and a redundant explanation thereof will be omitted.

Figure 8:
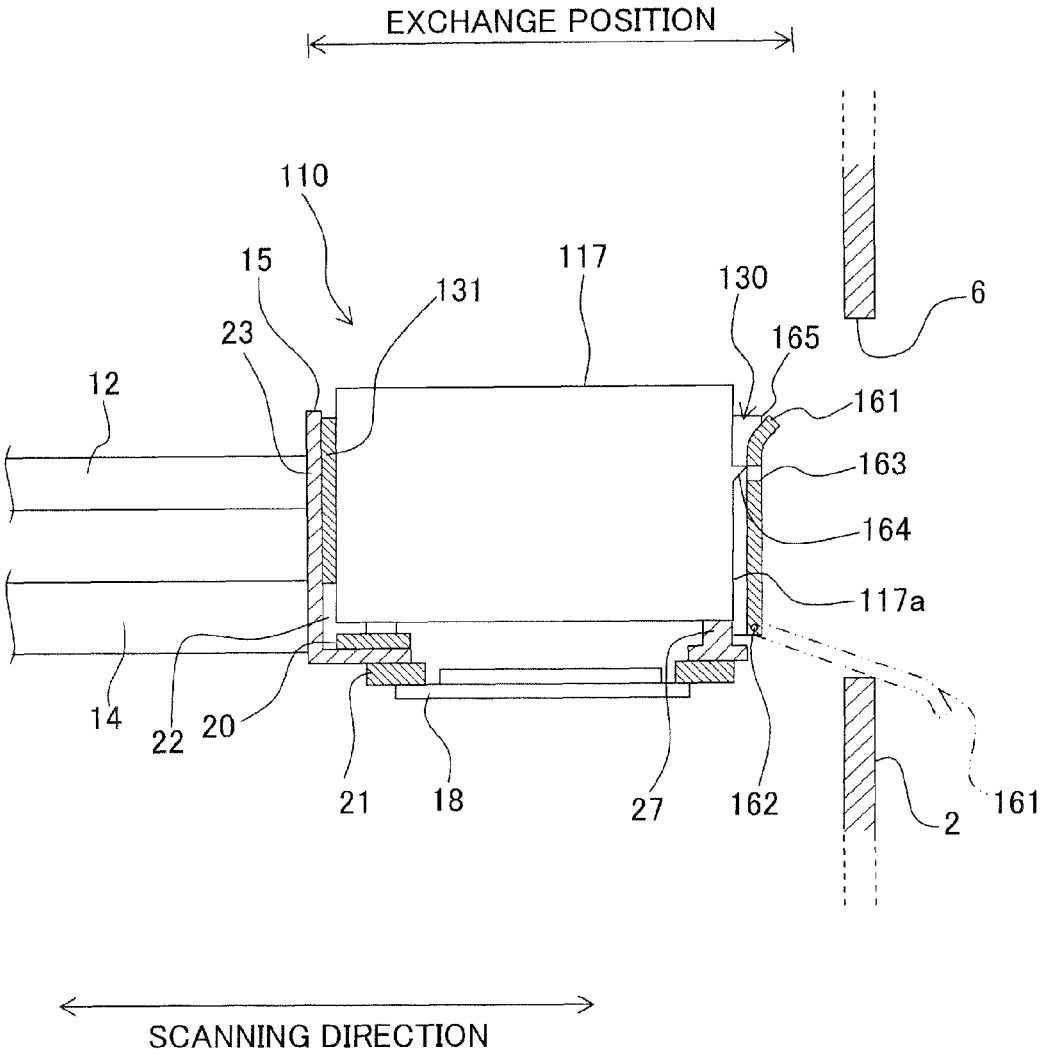
FIG. 8 is a front sectional view of a carriage unit provided in a multifunction printer according to a second embodiment of the present invention.

As shown in FIG. 8, in a carriage unit 110 of this embodiment as well, a box portion 23 of a carriage body 15 is formed so that a side, of an indented portion 23, facing a cartridge exchange port 6 is opened. Further, a hold portion 131 of a cartridge holder 116 defines a cartridge housing space 130 housing ink cartridges 117. A sidewall 161, of the hold portion 131, facing the cartridge exchange port 6 is configured to be swingable between a closing position and an opening position. Here, the closing position is a position where the sidewall 161 stands substantially upright to close the cartridge housing space 130 (refer to the solid line in FIG. 8), and the opening position is a position where the sidewall 161 lets the cartridge housing space 130 opened (see the two-dot chain line in FIG. 8). A swing shaft 162 extending horizontally in a transporting direction is provided on a lower end portion of the sidewall 161, and the sidewall 161 is coupled via the swing shaft 162 to a pair of walls 165 located on the hold portion 131 at both sides in the transporting direction. A catch groove 163 is provided in an inner surface of the sidewall 161, and cases 136 of the ink cartridges 117 have catch claws 164 projecting from their end surfaces 117*a* facing the cartridge exchange port 6.

When the sidewall 161 is set upright while the ink cartridges 117 are housed in the cartridge housing space 130, the catch claws 164 are caught in the catch groove 163. Consequently, the sidewall 161 is kept located at the closing position. Further, when the carriage unit 110 is located at a exchange position, a user can pull the sidewall 161 to a near side (that is, to the outside of the casing 2) by accessing the sidewall 161 via the cartridge exchange port 6 from the outside of a casing 2. Consequently, it is possible to release the catch claws 164 from the catch groove 163 to swing the sidewall 161. When the carriage unit 110 is located at the exchange position, the carriage unit 110 is adjacent to the cartridge exchange port 6 in the scanning direction, even though the carriage unit 110 is disposed inside the casing 2. When the sidewall 161 is swung in this state, an outer surface of the sidewall 161 is supported by a lower edge portion of the cartridge exchange port 6, so that the swinging of the sidewall 161 is restricted. At this time, an end portion of the sidewall 161 protrudes to the outside of the casing 2 from the cartridge exchange port 6. Thus, the sidewall 161 lies in the scanning direction on a lower portion of the cartridge exchange port 6. A user can install/remove the ink cartridge 117 while sliding the lower surface of the ink cartridge 117 along an inner surface of the sidewall 161, which enables the easy change of the ink cartridge 117. Further, when the sidewall 161 is opened, the sidewall 161 abuts on the edge portion of the cartridge exchange port 6 to stop swinging, and therefore a structure restricting a swing range need not be provided in the sidewall 161.

Third Embodiment

The same structures as those of the above-described embodiments will be denoted by the same reference numerals and symbols, and a redundant explanation thereof will be omitted.

Figure 9:
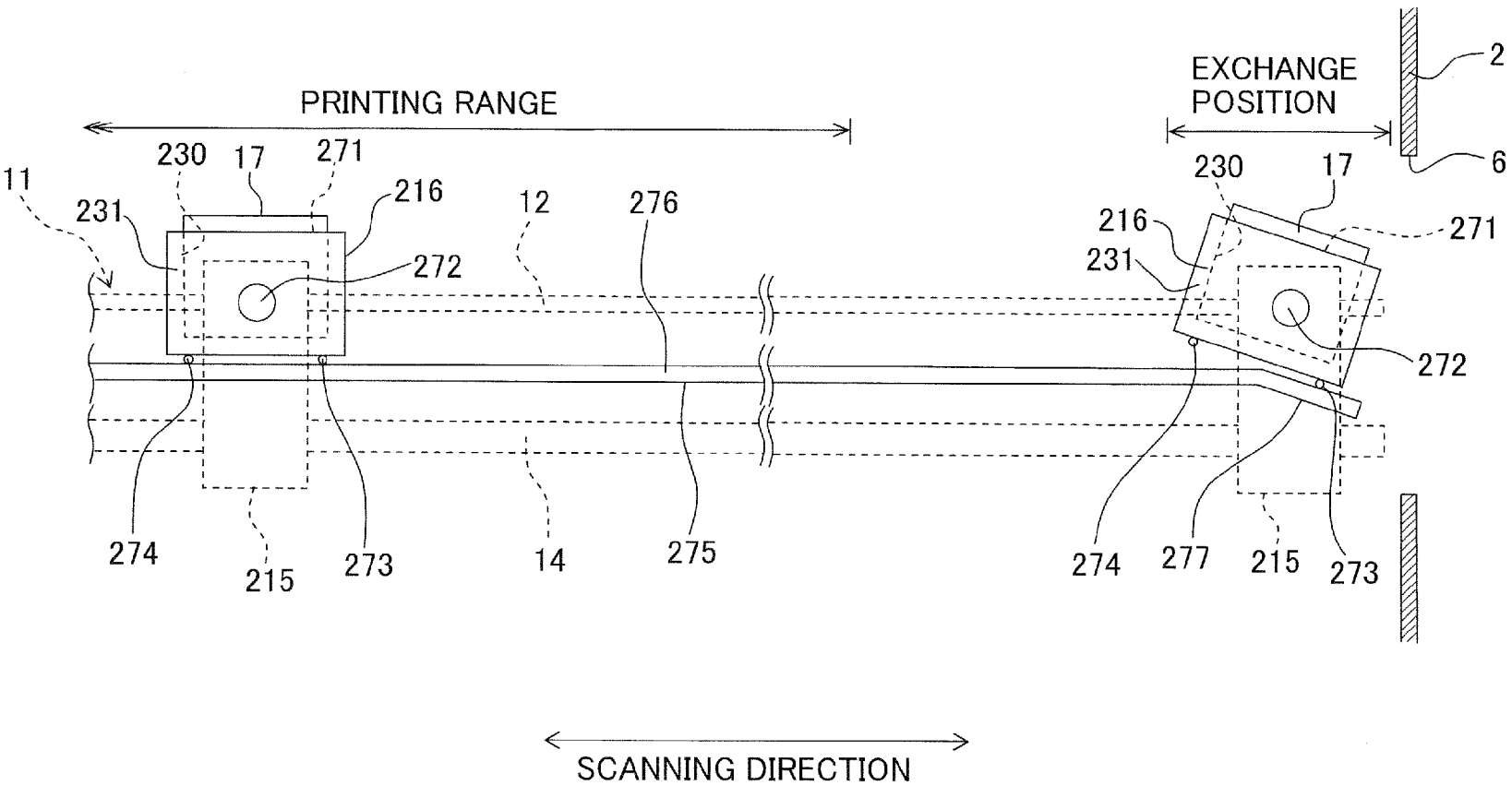
FIG. 9 is a front sectional view of a carriage unit provided in a multifunction printer according to a third embodiment of the present invention.

As shown in FIG. 9, in a carriage unit 210 of this embodiment, a carriage body 215 is supported by guide members 12 and is fixed to a belt 14 of a scanning mechanism 11. The guide members 12 extend on a straight line in a horizontal scanning direction, and when the scanning mechanism 11 is driven, the carriage body 215 horizontally moves in the scanning direction along the guide members 12.

A cartridge holder 216 has a hold portion 231 forming a cartridge housing space 230 housing ink cartridges 17 as described above, and the hold portion 231 has an opening portion 271 letting an upper side of the cartridge housing space 230 opened.

The cartridge holder 216 is swingably attached to the carriage body 215 via a swing shaft 272 extending in a transporting direction. Further, a pair of support parts 273, 274 is provided on an outer bottom portion of the cartridge holder 216, to be apart from each other in the scanning direction. The pair of support parts 273, 274 is placed on slide rails 275 close to the guide members 12, and weights (the gravitational forces) of the cartridge holder 126 and the ink cartridges 17 mounted thereon are supported by the slide rails 275. The slide rails 275 each have: a horizontal portion 276 extending in the horizontal scanning direction together with the guide members 12 in a printing range and at a maintenance position; and a downward slanting portion 277 continuing from the horizontal portion 276 at one end portion of a movable range of the carriage unit 210 and inclining downward as it goes toward one side of the scanning direction.

When the carriage unit 210 located in the printing range tries to move to a exchange position, at an instant of its movement start, the cartridge holder 216 is supported by the horizontal portions 276 of the slide rails 275 and thus the opening portion 271 of the hold portion 231 is in a state of being directed vertically upward. Then, when the carriage unit 210 comes close to the exchange position, the support parts 273, 274 of the cartridge holder 216 are supported by the downward slanting portions 277. Consequently, the cartridge holder 216 rotates clockwise around the swing shaft 272 in a front view. That is, the cartridge holder 216 swings so that the opening portion 271 is directed to the cartridge exchange port 6.

As described above, in this embodiment, the opening portion 271 is directed to the cartridge exchange port 6 adjacent to the carriage unit 210 in the scanning direction, in the state where the carriage unit 210 is stopping at the exchange position. Therefore, in changing the ink cartridge 17 from the outside of the casing 2 via the cartridge exchange port 6, a user can easily perform an operation of pulling out or placing the ink cartridge 17 from/in the cartridge housing space 230 via the opening portion 271.

Figure 10:
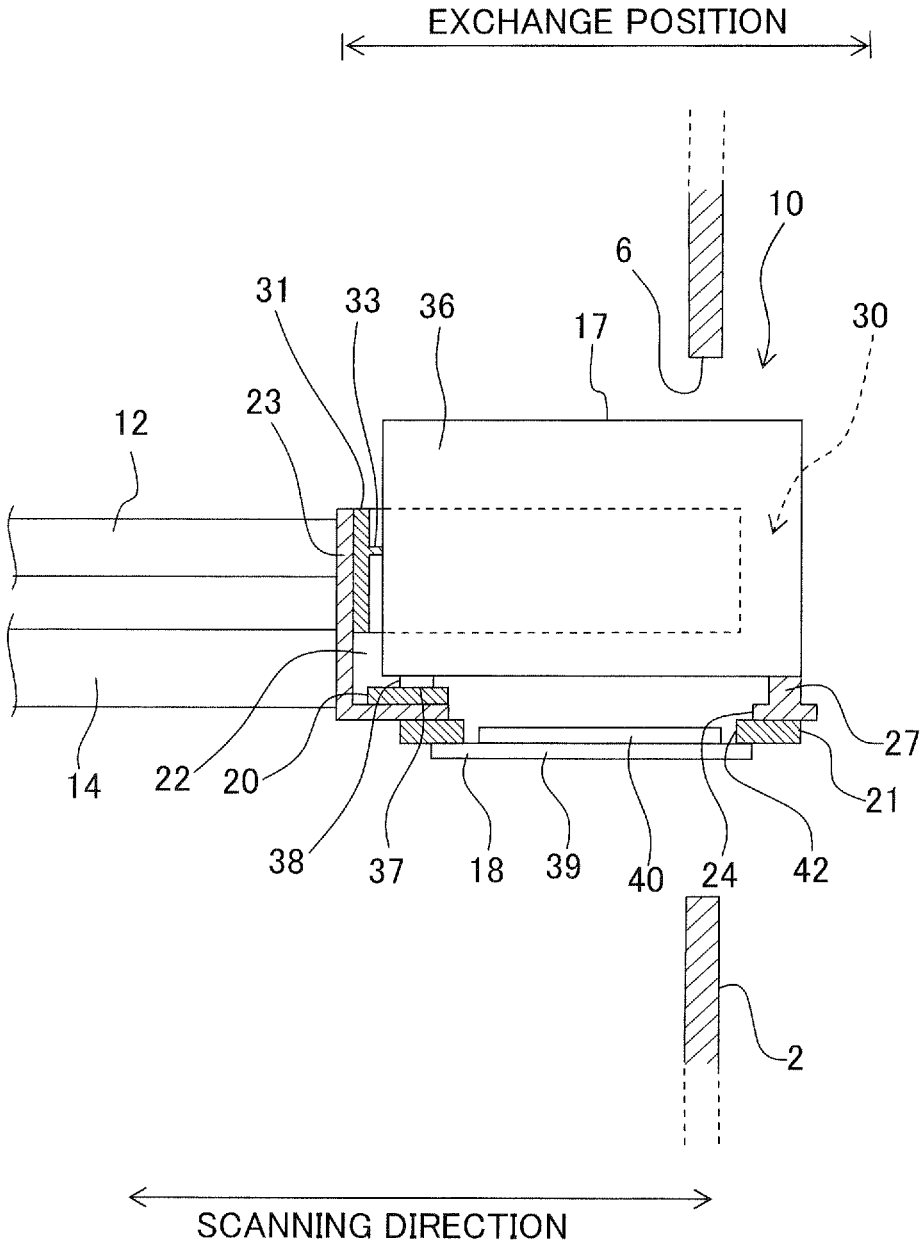
FIG. 10 is a front sectional view showing a state where part of the ink cartridge protrudes outside a casing.

In the foregoing, the embodiments of the present invention are explained, but the above-described structures are changeable appropriately within a range of the present teaching. For example, in the above-described embodiments, in the state where the carriage unit is stopping at the exchange position, the ink cartridges are located inside the casing 2. However, the present teaching is not limited to such a structure, and as shown in FIG. 10, for instance, a part of each of the ink cartridges may protrude to the outside of the casing 2. Further, the whole ink cartridges may protrude to the outside of the casing 2, though this structure is not shown. In the above-described embodiments, the scanning direction of the carriage unit and the transporting direction of the paper (medium) are perpendicular to each other, but the present teaching is not limited to such a structure. The scanning direction of the carriage unit and the transporting direction of the paper (medium) do not necessarily have to be perpendicular to each other, provided that they intersect with each other. Further, the image recording apparatus of the present teaching is applicable not only to the multifunction printer but also to any apparatus, provided that it is an apparatus capable of recording an image to a medium by jetting liquid to the medium. Here, the jetted liquid is not limited to the ink but may be changeable appropriately.

The present teaching realizes the easy change of a liquid cartridge and high space efficiency in an image recording apparatus of what is called an on-carriage type, and is beneficial when applied to, for example, an ink-jet printer of an on-carriage type and especially a multifunction printer having a large upper cover such as one including a scanner of a flat bet type.

What is claimed is:

1. An image recording apparatus which jets a liquid stored in cartridges onto a medium to records an image, the apparatus comprising:

a casing in which a cartridge exchange port, via which the cartridges are exchanged, is formed;

a carriage unit which is movable in the casing in a scanning direction intersecting with a transporting direction of the medium and in which the liquid cartridges are removably installed and are aligned in the transporting direction;

a liquid jetting head mounted on the carriage unit, on which a plurality of nozzle arrays through which the liquid supplied from the liquid cartridges is jetted is formed to be aligned in the scanning direction; and a controller which controls the carriage unit and the liquid jetting head so that the carriage unit reciprocates within a predetermined range in the scanning direction under a condition that the liquid jetting head jets the liquid to the medium, and that the carriage unit moves to a cartridge exchange position under a condition that the mounted liquid cartridge is to be changed, the cartridge exchange position being adjacent to the exchange port and being located outside the predetermined range in the scanning direction;

wherein the transporting direction and the scanning direction are perpendicular to each other;

wherein the liquid cartridges have a plurality of liquid outflow ports through which the liquid flows out, respectively, and the liquid outflow ports are disposed to align in the transporting direction under a condition that the liquid cartridges are mounted on the carriage unit;

wherein the liquid jetting head has a plurality of liquid inflow ports through which the liquid supplied from the liquid cartridges flows in, and the liquid inflow ports are aligned in the scanning direction; and wherein there is provided a channel forming member in the carriage unit, in which a plurality of connecting channels via which the liquid outflow orts communicate with corresponding liquid inflow ports out of the liquid inflow ports is formed.

2. The image recording apparatus according to claim 1;

wherein, the liquid cartridges mounted on the carriage unit are disposed inside the casing under a condition that the carriage unit is located at the cartridge exchange position.

3. The image recording apparatus according to claim 1;

wherein, a part of each of the liquid cartridges mounted on the carriage unit is disposed outside the casing under a condition that the carriage unit is located at the cartridge exchange position.

4. The image recording apparatus according to claim 1;

wherein the connecting channels are formed so that a connecting channel of the plurality of connecting channels having a longer channel length has a larger channel section.

5. The image recording apparatus according to claim 1;

wherein the connecting channels have substantially a same channel length.

6. The image recording apparatus according to claim 5, claim 1;

wherein the channel forming member includes a plurality of stacked plates;

wherein the connecting channels are formed in the stacked plates at different positions in a stacking direction; and wherein each of the connecting channels has:

a first portion extending in the transporting direction, with one end thereof communicating with one of the liquid outflow ports of the liquid cartridges; and a second portion extending in the scanning direction, with one end thereof connected to another end of the first portion and with another end communicating with the liquid inflow port.

7. An image recording apparatus which jets a liquid stored in cartridges onto a medium to records an image, the apparatus comprising:

a casing in which a cartridge exchange port, via which the cartridges are exchanged, is formed;

a carriage unit which is movable in the casing in a scanning direction intersecting with a transporting direction of the medium and in which the liquid cartridges are removably installed and are aligned in the transporting direction;

a liquid jetting head mounted on the carriage unit, on which a plurality of nozzle arrays through which the liquid supplied from the liquid cartridges is jetted is formed to be aligned in the scanning direction; and a controller which controls the carriage unit and the liquid jetting head so that the carriage unit reciprocates within a predetermined range in the scanning direction under a condition that the liquid jetting head jets the liquid to the medium, and that the carriage unit moves to a cartridge exchange position under a condition that the mounted liquid cartridge is to be changed, the cartridge exchange position being adjacent to the exchange port and being located outside the predetermined range in the scanning direction;

wherein the liquid cartridges have a plurality of liquid outflow port, respectively, through which the liquid flows out, and the liquid outflow ports are disposed to deviate from one another in the transporting direction under a condition that the liquid cartridges are mounted on the carriage unit;

wherein the liquid jetting head has a plurality of liquid inflow ports through which the liquid supplied from the liquid cartridges flows in, and the liquid inflow ports are disposed to overlap with the liquid outflow ports;

wherein the channel forming member includes a plate-shaped plate member; and wherein the connecting channels extend in a thickness direction of the plate member to connect the liquid outflow ports and the liquid inflow ports.

8. An image recording apparatus which jets a liquid stored in cartridges onto a medium to records an image, the apparatus comprising:

a casing in which a cartridge exchange port, via which the cartridges are exchanged, is formed;

a carriage unit which is movable in the casing in a scanning direction intersecting with a transporting direction of the medium and in which the liquid cartridges are removably installed and are aligned in the transporting direction;

a liquid jetting head mounted on the carriage unit, on which a plurality of nozzle arrays through which the liquid supplied from the liquid cartridges is jetted is formed to be aligned in the scanning direction; and a controller which controls the carriage unit and the liquid jetting head so that the carriage unit reciprocates within a predetermined range in the scanning direction under a condition that the liquid jetting head jets the liquid to the medium, and that the carriage unit moves to a cartridge exchange position under a condition that the mounted liquid cartridge is to be changed, the cartridge exchange position being adjacent to the exchange port and being located outside the predetermined range in the scanning direction;

wherein the transporting direction and the scanning direction are perpendicular to each other;

wherein the carriage unit has a plurality of sidewalls demarcating a cartridge housing space housing the liquid cartridges; and wherein a sidewall facing the cartridge exchange port out of the sidewalls is formed to be swingable between a closing position at which the sidewall stands substantially vertically to close the cartridge housing space and an opening position at which the sidewall opens the cartridge housing space.

9. An image recording apparatus which jets a liquid stored in cartridges onto a medium to records an image, the apparatus comprising:

a casing in which a cartridge exchange port, via which the cartridges are exchanged, is formed;

a carriage unit which is movable in the casing in a scanning direction intersecting with a transporting direction of the medium and in which the liquid cartridges are removably installed and are aligned in the transporting direction;

a liquid jetting head mounted on the carriage unit, on which a plurality of nozzle arrays through which the liquid supplied from the liquid cartridges is jetted is formed to be aligned in the scanning direction; and a controller which controls the carriage unit and the liquid jetting head so that the carriage unit reciprocates within a predetermined range in the scanning direction under a condition that the liquid jetting head jets the liquid to the medium, and that the carriage unit moves to a cartridge exchange position under a condition that the mounted liquid cartridge is to be changed, the cartridge exchange position being adjacent to the exchange port and being located outside the predetermined range in the scanning direction;

wherein the transporting direction and the scanning direction are perpendicular to each other;

wherein the carriage unit has:

a carriage body movable in the scanning direction; and a cartridge installation section attached to the carriage body to be swingable around an axis extending in the transporting direction;

wherein an opening portion, in which the cartridge housing space housing the liquid cartridges is opened upward, is formed in the cartridge installation section; and wherein the cartridge installation section is swingable, with the opening portion directed to the cartridge exchange port under a condition that the carriage unit is located at the cartridge exchange position.

* * * * *